US008950847B2

(12) United States Patent
Seki et al.

(10) Patent No.: US 8,950,847 B2
(45) Date of Patent: Feb. 10, 2015

(54) RECORDING APPARATUS

(75) Inventors: Takanori Seki, Suwa (JP); Kenichi Ishihara, Matsumoto (JP); Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 139 days.

(21) Appl. No.: 13/492,172

(22) Filed: Jun. 8, 2012

(65) Prior Publication Data

US 2012/0314010 A1 Dec. 13, 2012

(30) Foreign Application Priority Data

Jun. 10, 2011 (JP) ..... 2011-130639

(51) Int. Cl.

| | |
|---|---|
| ***B41J 2/165*** | (2006.01) |
| ***B41J 25/308*** | (2006.01) |
| ***B41J 2/17*** | (2006.01) |
| ***B41J 2/185*** | (2006.01) |
| ***B41J 11/00*** | (2006.01) |
| ***B41J 29/02*** | (2006.01) |

(52) U.S. Cl.

CPC ..... *B41J 2/16526* (2013.01); *B41J 2/1721* (2013.01); *B41J 2/185* (2013.01); *B41J 11/002* (2013.01); *B41J 29/02* (2013.01)

USPC ..... 347/36; 347/33; 347/8

(58) Field of Classification Search

CPC ..... B41J 11/02; B41J 11/14; B41J 11/20; B41J 11/36; B41J 17/16; B41J 17/18; B41J 17/20; B41J 2/16523; B41J 2/1721; B41J 2002/1728; B41J 2002/1735; B41J 2002/1742; B41J 2002/1853; B41J 2002/1856

USPC ..... 347/22, 29, 31, 32, 33, 36

See application file for complete search history.

(56) References Cited

U.S. PATENT DOCUMENTS

| | | | | |
|---|---|---|---|---|
| 5,526,028 | A * | 6/1996 | Rottman | 347/23 |
| 6,382,767 | B1 * | 5/2002 | Greive | 347/30 |
| 6,805,427 | B2 * | 10/2004 | Hosono | 347/31 |
| 7,165,826 | B2 * | 1/2007 | Sugaya et al. | 347/32 |
| 7,334,862 | B2 * | 2/2008 | Kachi | 347/22 |
| 7,651,213 | B2 * | 1/2010 | Konno et al. | 347/102 |
| 7,771,040 | B2 * | 8/2010 | Nakashima | 347/104 |
| 7,832,853 | B2 * | 11/2010 | Nakashima | 347/104 |
| 7,845,790 | B2 * | 12/2010 | Baker et al. | 347/104 |
| 8,287,107 | B2 * | 10/2012 | Terada | 347/85 |
| 2002/0044168 | A1 * | 4/2002 | Hashi et al. | 347/32 |
| 2002/0154202 | A1 * | 10/2002 | Yamamoto et al. | 347/104 |
| 2002/0191064 | A1 * | 12/2002 | Ishikawa et al. | 347/104 |
| 2003/0038857 | A1 * | 2/2003 | Yamamoto et al. | 347/29 |
| 2004/0119777 | A1 * | 6/2004 | Nakashima et al. | 347/32 |
| 2004/0228669 | A1 * | 11/2004 | Nakashima et al. | 400/635 |
| 2004/0263560 | A1 * | 12/2004 | Nakashima | 347/32 |

(Continued)

FOREIGN PATENT DOCUMENTS

JP 2009-279780 12/2009

*Primary Examiner* — Matthew Luu
*Assistant Examiner* — Patrick King
(74) *Attorney, Agent, or Firm* — Workman Nydegger

(57) ABSTRACT

A recording apparatus includes a recording head which discharges liquid onto a recording material, thereby performing recording; and a waste liquid recovery device which recovers waste liquid which has not been attached to the recording material, of liquid discharged from the recording head, wherein the waste liquid recovery device includes a movable sheet-like member which is provided on a side facing the recording head and receives the waste liquid which has not been attached to the recording material.

11 Claims, 11 Drawing Sheets

(56) References Cited

U.S. PATENT DOCUMENTS

2006/0066703 A1* 3/2006 Kadomatsu et al. ..... 347/102
2007/0268330 A1* 11/2007 Zengo et al. ..... 347/33
2011/0199429 A1* 8/2011 Hayashi ..... 347/33

* cited by examiner

RECORDING APPARATUS

BACKGROUND

1. Technical Field

The present invention relates to a recording apparatus such as an ink jet printer, which discharges liquid such as ink onto a recording material, thereby carrying out desired recording.

2. Related Art

In the past, ink jet printers which discharge liquid (ink) from a recording head onto a recording material such as single sheet paper or rolled paper, thereby carrying out desired recording, have been developed in large numbers. Among such ink jet printers, there is an ink jet printer which can carry out recording with a mesh cloth having openings, such as fabric or mesh tarpaulin, as a recording material, as shown in JP-A-2009-279780.

Then, in the ink jet printer aimed at the mesh cloth or the like, since waste liquid (waste ink) which has not been used in execution of recording, of liquid discharged from the recording head, is generated in large amounts, a waste liquid recovery device which recovers the waste liquid is provided.

In JP-A-2009-279780, a waste liquid recovery device provided with a waste ink tray disposed in a facing area with respect to a recording head with a gradual slope is disclosed. This waste liquid recovery device has a structure that requires maintenance work in which a user transfers waste liquid accumulated in the waste ink tray to a recovery tank or the like at an appropriate timing.

However, if the size of the ink jet printer is increased, the amount of waste liquid which is generated becomes a great amount, so that the size of the waste ink tray is also increased. Therefore, there is a problem in that a burden to a user who performs the maintenance work increases.

Further, in a serial type ink jet printer which carries out recording by reciprocating a recording head in a width direction crossing a transport direction of a recording material, after the recording head is moved to a flushing position provided at a separate distant position outside a recording execution area, a flushing operation is performed. For this reason, the flushing operation becomes a factor interfering with shortening of a recording execution time (improvement in throughput). In addition, flushing refers to blowing away ink from nozzle openings of the recording head to refresh the nozzle openings.

SUMMARY

An advantage of some aspects of the invention is that it provides a recording apparatus in which waste liquid can be recovered with a reduced burden to a user of requirement for disposal of waste liquid and shortening of a recording execution time can also be attained by shortening the movement distance of a recording head at the time of a flushing operation.

According to a first aspect of the invention, there is provided a recording apparatus including: a recording head which discharges liquid onto a recording material, thereby performing recording; and a waste liquid recovery device which recovers waste liquid which has not been attached to the recording material, of liquid discharged from the recording head, wherein the waste liquid recovery device includes a movable sheet-like member which is provided on a side facing the recording head and receives the waste liquid which has not been attached to the recording material.

Here, the "waste liquid which has not been attached to the recording material" is equivalent to liquid (ink) which is discharged from the recording head in a flushing operation, liquid (ink) which is outside of an edge of the recording material when carrying out recording without margins, liquid (ink) which has passed through an opening of a mesh when performing recording by discharging liquid (ink) to a mesh cloth or the like, or the like.

Further, the "movable sheet-like member receiving the waste liquid which has not been attached to the recording material" means that at the time of execution of recording and a flushing operation, the sheet-like member is provided so as to be able to cover a discharge range which liquid that is discharged from nozzle openings of the recording head reaches, thereby receiving waste liquid. Accordingly, in a case where the recording head is a serial type recording head that is supported on a carriage which reciprocates in a width direction crossing the transport direction of the recording material, the sheet-like member is provided so as to cover a liquid discharge range taking into account a moving range of the recording head.

According to this aspect, in the case of a recording apparatus with a serial type recording head mounted thereon, it becomes possible to carry out the flushing operation in the vicinity outside the width of the recording material, and accordingly, it is possible to shorten a recording execution time by shortening the movement distance of the recording head at the time of the flushing operation.

Further, according to this aspect, the sheet-like member with liquid discharged from the recording head attached thereto moves to an end portion on the other side of a facing area with respect to the recording head, thereby being able to perform recovery. Therefore, waste liquid disposal work that has been performed by a user in the past becomes unnecessary. That is, the waste liquid can be recovered with a reduced burden to a user of requirement for disposal of the waste liquid.

Further, since the waste liquid recovery device is provided with the movable sheet-like member extending from an end portion on one side of an area facing the recording head to an end portion on the other side, it is possible to momentarily change the position of the facing surface of the sheet-like member with respect to the recording head, which is present in the landing position of liquid which is discharged from the recording head. In this way, since the waste liquid can be received by the facing surface of the sheet-like member to which liquid discharged from the recording head has not been attached, excellent waste liquid recovery performance is always exerted.

According to a second aspect of the invention, in the recording apparatus according to the first aspect, the recording head can reciprocate in a width direction crossing a transport direction of the recording material, the sheet-like member can move along a direction of movement of the recording head, the recording apparatus may include a control section which controls each operation of the recording head and the waste liquid recovery device, and the control section may be configured so as to set a flushing position of the recording head in response to the width dimension of the recording material.

According to this aspect, in a recording apparatus with a serial type recording head mounted thereon, since the flushing position of the recording head is set in response to the width dimension of the recording material, it becomes possible to carry out the flushing operation in the vicinity outside the width of the recording material, and accordingly, it is possible to shorten a recording execution time by shortening the movement distance of the recording head at the time of the flushing operation.

According to a third aspect of the invention, in the recording apparatus according to the first or the second aspect, the waste liquid recovery device may include a first roller which is provided at an upstream position in a direction of movement of the sheet-like member and a second roller which is provided at a downstream position in the direction of movement of the sheet-like member, the sheet-like member may be a long roll-shaped member wound around the first roller into the form of a roll, and the roll-shaped member may be configured so as to be taken up by the second roller.

According to this aspect, a new sheet-like member which is sent out from a delivery roller that is the first roller is always used for recovery of waste liquid, and the sheet-like member with waste liquid captured is taken up by a take-up roller that is the second roller, thereby being automatically collected.

Therefore, waste liquid disposal work that has been performed by a user in the past becomes unnecessary.

According to a fourth aspect of the invention, in the recording apparatus according to the first or the second aspect, the waste liquid recovery device may include a driving section which is provided on one end side in a direction of movement of the sheet-like member and a driven section which is provided on the other end side in the direction of movement of the sheet-like member, and the sheet-like member may be an endless belt which is wound to pass around the driving section and the driven section.

According to this aspect, it becomes possible to continuously use repeatedly the same sheet-like member to the extent that ink capture performance is exerted. Therefore, it is environmentally friendly, compared to the sheet-like member of a disposable type, and a replacement frequency of the sheet-like member also becomes low.

According to a fifth aspect of the invention, in the recording apparatus according to any one of the first to the fourth aspects, the sheet-like member may be provided with a plurality of side edge flaps by having slits at appropriate intervals at both side edges, and the side edge flaps may be configured to be able to rise up to the recording head side.

According to this aspect, due to the side edge flaps formed at the side edges of the sheet-like member, waste liquid abandoned to the facing surface is carried to and recovered at an end portion on the other side of a facing area with respect to the recording head without the waste liquid from left and right side edge portions of the sheet-like member spilling down.

Further, since at a curved portion of the sheet-like member, free ends of adjacent side edge flaps are deformed so as to be radially opened, smooth movement of the sheet-like member becomes possible without applying an excessive force to the sheet-like member.

According to a sixth aspect of the invention, in the recording apparatus according to any one of the first to the fourth aspects, the sheet-like member may be formed in the shape of bellows capable of expanding and contracting in a direction crossing a direction of movement.

According to this aspect, waste liquid receiving groove portions are formed by deforming the shape of the sheet-like member itself into the shape of bellows without disposing a separate member on the facing surface of the sheet-like member with respect to the recording head. Therefore, the waste liquid recovery device can be constituted with very simple configuration and waste liquid abandoned to the facing surface of the sheet-like member with respect to the recording head is guided by the waste liquid receiving groove portions and carried to and recovered at an end portion on the other side of a facing area with respect to the recording head.

Further, since by deforming the sheet-like member into the shape of bellows, a sheet-like member having a width dimension larger than a width dimension required to receive waste liquid discharged from the recording head can be used, a waste ink capture rate is improved by the expansion of the area of the facing surface of the sheet-like member with respect to the recording head.

According to a seventh aspect of the invention, in the recording apparatus according to any one of the first to the sixth aspects, a distance between the sheet-like member and the recording head may be configured to be variable.

According to this aspect, at the time of recording with margins, by moving the sheet-like member to a position where the sheet-like member comes into contact with and supports the back surface (the non-recording surface) of the recording material, it is possible to make the sheet-like member have a function as a support member which supports the recording material from the back surface side during recording execution.

In the case of a structure in which a place of the sheet-like member with waste liquid attached thereto due to recording without margins or flushing passes through the back surface side of the recording material, by moving the sheet-like member to a spaced position where the sheet-like member does not come into contact with the back surface of the recording material, it is possible to prevent the recording material from being contaminated by the waste liquid.

According to an eighth aspect of the invention, in the recording apparatus according to the seventh aspect, the distance may be configured to be capable of being set to be different sizes in an area in the width of the recording material and an area outside the width.

According to this aspect, in the case of a structure in which a place of the sheet-like member with waste liquid attached thereto does not pass through the back side of the recording material, for example, in the case of recording without margins, the portion of the sheet-like member which is located on the back side of the recording material is moved to a position where the sheet-like member comes into contact with and supports the back surface (the non-recording surface) of the recording material. On the other hand, a place of the sheet-like member which receives waste liquid abandoned outside the recording material in recording without margins is moved to a spaced position where the sheet-like member does not come into contact with the back surface of the recording material, whereby it is possible to prevent the recording material from being contaminated by the waste liquid.

According to a ninth aspect of the invention, in the recording apparatus according to any one of the first to the eighth aspects, the liquid which is discharged from the recording head may be light curing ink which is cured in response to light, and a light irradiation section which irradiates the light curing ink discharged from the recording head with light may be provided near a side of the recording head.

Here, the term "light" as used in this specification is used in a broad sense which includes, in addition to a range including visible light in which in general, a short-wavelength end has a range of 360 nm to 400 nm and a long-wavelength end has a range of 760 nm to 830 nm, ultraviolet having a wavelength in a range of 1 nm to 380 nm shorter than visible light, and infrared having a wavelength in a range of 780 nm to 1 mm longer than visible light, electromagnetic waves having a wavelength shorter than ultraviolet or electromagnetic waves having a wavelength longer than infrared.

Therefore, the case of the "light curing ink" is set to mean a variety of ink which is cured in response to, in addition to the ranges of visible light that is generally in the range of light, ultraviolet, and infrared, electromagnetic waves having a short wavelength or a long wavelength outside of these ranges.

According to the aspects, in a case where also at the time of the flushing operation, light is irradiated from the light irradiation section, it becomes possible to recover the light curing ink attached to the facing surface of the sheet-like member with respect to the recording head, in a hardened state. Further, it becomes possible to repeatedly use the sheet-like member by peeling the hardened light curing ink from the sheet-like member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
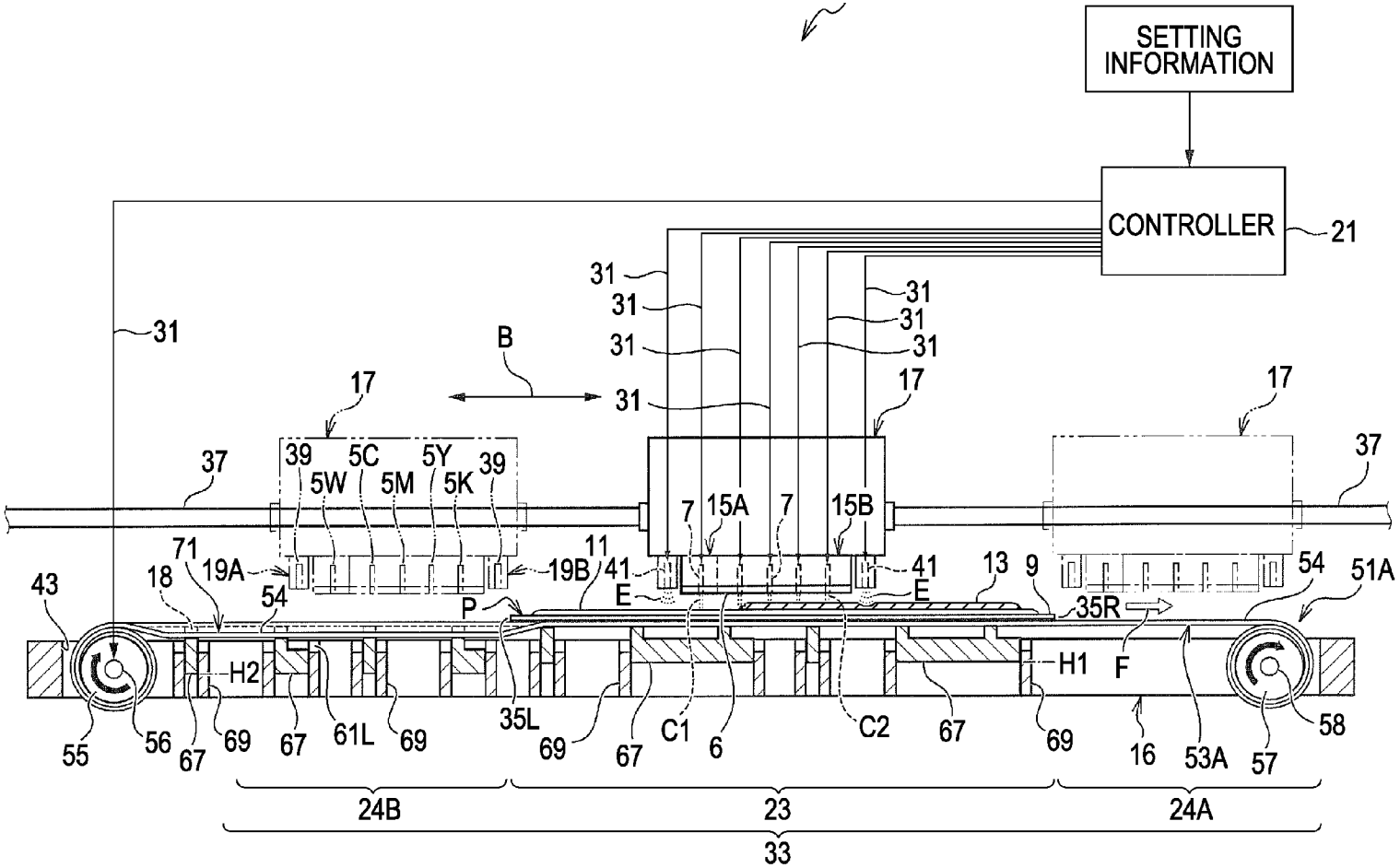
FIG. 1 is a front view of a main section, showing the schematic configuration of the internal structure of a recording apparatus related to Example 1 of the invention.

Hereinafter, the configuration of a recording apparatus 1 according to the invention and an operation aspect of the recording apparatus 1 will be specifically described on the basis of Example 1 shown in FIGS. 1 to 4 and 11, Example 2 shown in FIGS. 5 and 6, and Example 3 shown in FIGS. 7 and 8.

In addition, in the following description, first, the basic configuration of the recording apparatus 1 according to the invention will be described on the basis of FIGS. 1 and 2, and subsequently, the characteristic configurations of the invention will be described in order on the basis of three examples, Example 1 to Example 3.

The recording apparatus 1 shown is a serial type ink jet printer 1 (the same reference numeral as the "recording apparatus" is used) in which, as an example, band feed printing is possible and a carriage 17 reciprocates in a width direction B crossing a transport direction A of a recording material P.

In the recording material P on which recording can be carried out by the ink jet printer 1, in addition to various papers having different paper thicknesses and natures or resin film, a mesh cloth having openings, such as fabric or mesh tarpaulin, is included. In the mesh cloth, since waste liquid (hereinafter, there is also a case where it is referred to as "waste ink") which is not used in execution of recording becomes greater than in other recording materials, the effect of applying the invention is great.

Then, the ink jet printer 1 is provided with a transport mechanism 3 (FIG. 2) which can intermittently transport the recording material P in the transport direction A by a given band feed amount D, and a recording head 15 which has a nozzle row 5 arranged in the width direction B in a nozzle formation face 6 (FIG. 1) and forms a foundation 11 or an image 13 by carrying out desired recording on a recording surface 9 of the recording material P by ultraviolet (UV) curing ink C (in the case of distinguishing between different types, symbols C1 and C2 are used) that is one example of light curing ink which is discharged from a plurality of nozzle openings 7 forming the nozzle row 5.

In addition, with respect to the "recording head 15", two types are present, as will be described later. However, when the distinction between the types is not required, the recording head is simply denoted by only Arabic numeral "15", and in the case of distinguishing between the types, a distinction is performed by adding different letters to the Arabic numeral, like "15A" and "15B". This manner of distinction is also appropriately applied to other constituent members.

Further, the ink jet printer 1 is provided with the carriage 17 which reciprocates in the above-mentioned width direction B with the recording head 15 mounted thereon, and a waste liquid recovery device (hereinafter also referred to as a "waste ink recovery device") 51 that is a characteristic constituent element of the invention which recovers waste ink C which has not been used in execution of recording, of the ink C discharged from the recording head 15.

Further, below the reciprocating range of the carriage 17, a support member 16 is provided which supports the lower surface of the recording material P transported thereto by the transport mechanism 3 so as to keep the gap between the nozzle formation face 6 of the recording head 15 and the recording surface 9 of the recording material P at a given distance and guides transport of the recording material P.

Further, in a facing area 33 with respect to the reciprocating recording head 15 of the upper surface of the support member 16, the above-mentioned waste ink recovery device 51 is provided which is provided with a movable sheet-like member 53 extending from an end portion on one side of the facing area 33 with respect to an end portion on the other side.

Then, in this example, the entirety of a facing surface 54 with respect to the recording head 15 of the sheet-like member 53 is made so as to be able to be used as a recording execution area 23 that is a range in the width direction B in which the recording head 15 moves during recording execution, and a flushing position 24 where the recording head 15 is located during a flushing operation.

Therefore, in this example, a configuration is made such that in addition to a flushing position 24A which is located outside a side edge 35R on one side that becomes the reference edge of the recording material P, a neighborhood area outside a side edge 35L on the other side of the recording material P, that changes according to the width size of the recording material P, can also be used as a flushing position 24B.

In addition, the flushing position 24A may also be configured by a separate flushing receiving section from the sheet-like member 53 without using the sheet-like member 53. As an example of the flushing receiving section, a hole structure with an ink absorber disposed in a lower portion of a hole can be given. The details will be described later.

Further, the ink jet printer 1 is provided with a light irradiation section 19 which is mounted on the carriage 17 so as to be provided in parallel in the vicinity of a side in the width direction of the recording head 15, as an example, and which is constituted by a light-emitting element row 39 that is formed by a plurality of light-emitting diodes (hereinafter also referred to as "LEDs") 41, each of which is one example of a light-emitting element which irradiates the UV curing ink C discharged from each nozzle opening 7 with ultraviolet (UV light) E that is one example of light, thereby curing the UV curing ink C.

Figure 2:
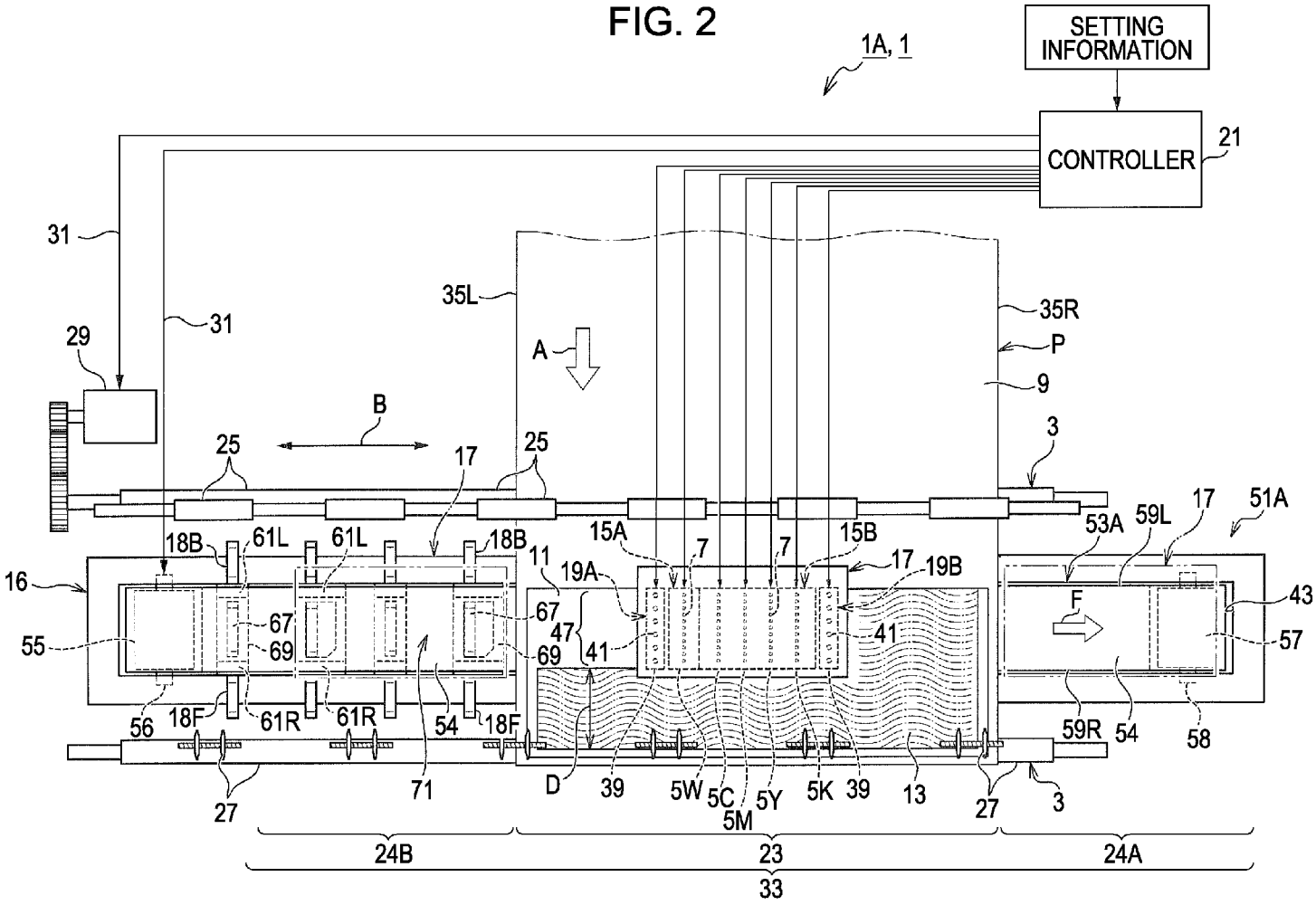
FIG. 2 is a plan view of a main section, showing the schematic configuration of the internal structure of the recording apparatus related to Example 1 of the invention.

As shown in FIGS. 1 and 2, the transport mechanism 3 is configured, as an example, to include a roller for transport 25 which is constituted by a pair of nip rollers that is provided at the upstream position of the recording execution area 23 that is an area in the transport direction A where recording is actually carried out, and a roller for discharge 27 which is likewise constituted by a pair of nip rollers that is provided at the downstream position of the recording execution area 23.

Then, a configuration is made such that a signal 31 which, in this example, gives instructions for transport of the band feed amount D is transmitted from a control section 21 (described later) to a motor 29 which drives the roller for transport 25 and the roller for discharge 27, whereby the recording material P is intermittently sent by the band feed amount D.

As the recording head 15, two types of recording heads, a first recording head 15A which discharges ink for foundation C1 and a second recording head 15B which discharges ink for image formation C2, are provided, and, as an example, the first recording head 15A is disposed on the left side in FIGS. 1 and 2 and the second recording head 15B is disposed on the right side in FIGS. 1 and 2.

In addition, in the first recording head 15A of these, a nozzle row 5W which discharges the ink for foundation C1 such as white (W), gold (G), or silver (S), for example, is provided. Further, in the second recording head 15B, four nozzle rows 5C, 5M, 5Y, and 5K which individually discharge the ink for image formation C2 of four colors, cyan (C), magenta (M), yellow (Y), and black (K), as an example, are provided in parallel at given intervals in the width direction B.

Then, a signal 31 which gives instructions for an ink discharge amount corresponding to the position of each nozzle opening 7 is transmitted from the control section 21 (described later) to each of the nozzle rows 5W, 5C, 5M, 5Y, and 5K, so that adjustment of the ink discharge amount is attained.

Further, in the ink jet printer 1 shown, the ink C which is discharged from each nozzle opening 7 of the nozzle rows 5W, 5C, 5M, 5Y, and 5K is constituted by the UV curing ink C which is subjected to irradiation of the UV light E, thereby being cured, as described above.

The "UV curing ink" is ink having an excellent rapid curing property, which is cured and fixed by irradiation of the UV light E, and has a feature that a volume shrinkage rate after curing is significantly small compared to pigment ink which is cured and fixed by evaporating a solvent by heater heating.

Further, the "UV curing ink" is ink which is environmentally friendly because it does not contain a solvent component and which is suitable for the recording material P of film series with low ink-absorption property because it is instantaneously cured by irradiation of the UV light E.

The carriage 17 is a reciprocating transport mechanism which reciprocates the recording head 15 and the light irradiation section 19 in the width direction along a carriage guide shaft 37 extending in the width direction B.

Power for reciprocating the carriage 17 is received from a motor (not shown) in which forward and reverse rotation is possible and precise feed control for each unit step is possible, and rotation of the motor is transmitted to the carriage 17 through a toothed belt (not shown).

As the light irradiation section 19, two types of light irradiation sections, a first light irradiation section 19A which is disposed near, for example, the left side in FIGS. 1 and 2 of the first recording head 15A so as to cure the ink for foundation C1 and a second light irradiation section 19B which is disposed near, for example, the right side in FIGS. 1 and 2 of the second recording head 15B so as to cure the ink for image formation C2, are provided.

Then, in the ink jet printer 1 shown, the two types of light irradiation sections 19A and 19B irradiate the UV curing ink C discharged onto the recording surface 9 of the recording material P with the UV light E of a given amount of irradiation, thereby carrying out curing and fixing of the UV curing link C.

Further, the two types of light irradiation sections 19A and 19B are constituted by the light-emitting element rows 39 provided with a plurality of LEDs 41 having an array corresponding to the array of the nozzle openings 7 of each of the nozzle rows 5W, 5C, 5M, 5Y, and 5K in the two types of recording heads 15A and 15B.

Then, a signal 31 which gives instructions for the amount of irradiation or presence or absence of irradiation of the UV light E corresponding to the position of each LED 41 is transmitted from the control section 21 (described later) to each LED 41, so that adjustment of the amount of irradiation and switching between presence and absence of irradiation of the UV light E are attained.

Example 1

Refer to FIGS. 1 to 4, and 11

Figure 3:
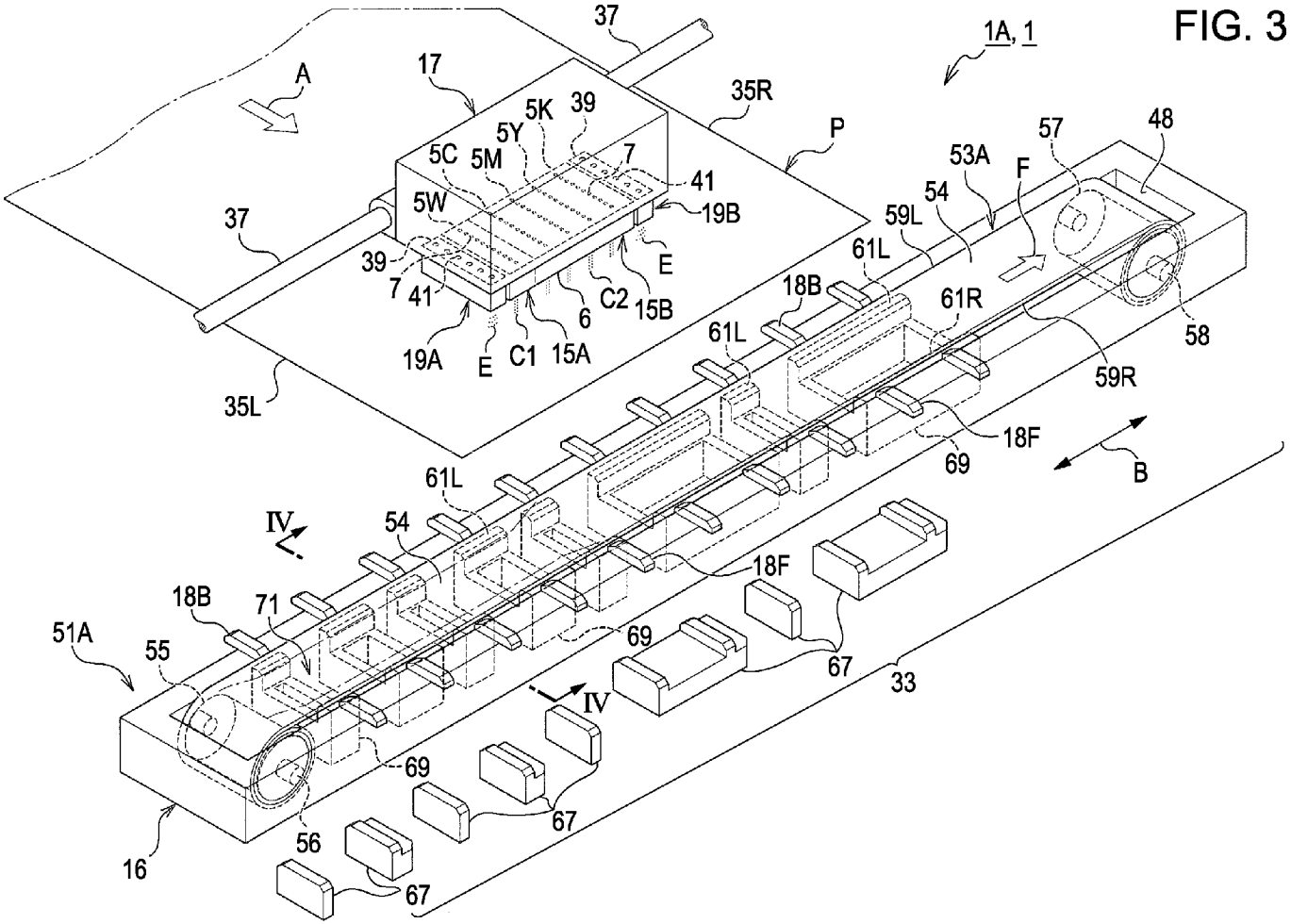
FIG. 3 is an enlarged perspective view showing the periphery of a waste liquid recovery device of the recording apparatus related to Example 1 of the invention.

As shown in FIG. 3, in an ink jet printer 1A related to Example 1, a waste ink recovery device 51A is provided with a delivery roller 55 that is a first roller which is provided at the upstream position in a direction of movement F of a sheet-like member 53A, and a take-up roller 57 that is a second roller which is provided at the downstream position in the direction of movement F of the sheet-like member 53A.

Then, in this example, the sheet-like member 53A is constituted by a long roll-shaped member wound around the delivery roller 55 into the form of a roll, and disposed such that a delivery end of the roll-shaped member is taken up by the take-up roller 57.

In addition, the delivery roller 55 and the take-up roller 57 can also be set such that one of these is a driving roller and the other is a driven roller and can also be set such that the two are driving rollers.

Further, as a material of the sheet-like member 53A, it is also possible to form it of a material with no water absorbability such as synthetic rubber or soft synthetic resin film and it is also possible to form it of a material with water absorbability such as paper or nonwoven fabric.

Figure 4:
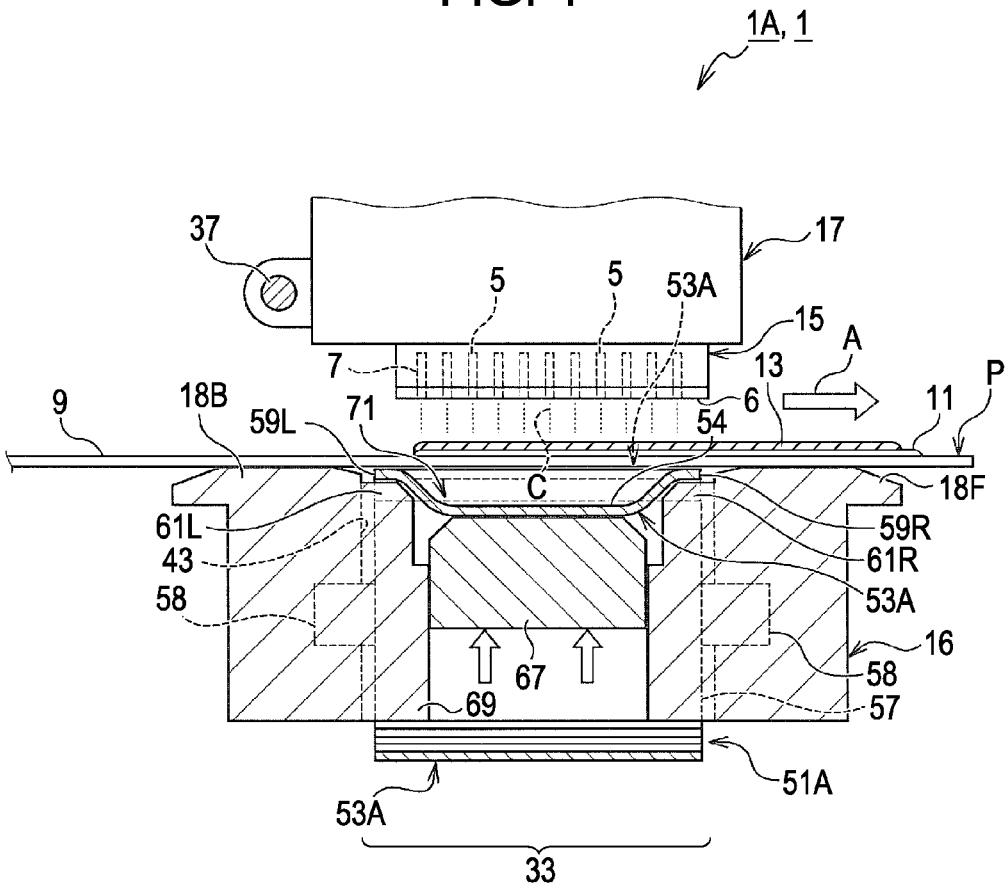
FIG. 4 is an enlarged cross-sectional view taken along line IV-IV of FIG. 3, showing the periphery of the waste liquid recovery device of the recording apparatus related to Example 1 of the invention.

Further, as shown in FIGS. 3 and 4, the support member 16, on which the waste ink recovery device 51A configured in this way is installed, is a block-like member of a rectangular shape in a plan view that is long in the width direction B, and on the upper surface of the support member 16, a plurality of support ribs 18 which comes into direct contact with the lower surface that becomes the supported surface of the recording material P, thereby supporting the recording material P, is disposed at appropriate intervals in the width direction B in the front and the rear with a central opening portion 43 interposed therebetween.

In addition, in the case of distinguishing between the support ribs 18 which are disposed before and after the opening portion 43, the two are distinguished from each other by setting the support ribs which are located on the upstream side in the transport direction A to be support ribs 18B and setting the support ribs which are located on the downstream side to be support ribs 18F. Further, the opening portion 43 becomes an installation space in which the above-mentioned waste ink recovery device 51A is installed, and in this example, the opening portion 43 is formed by a rectangular hole-shaped window portion, as an example.

A left end portion and a right end portion of the opening portion 43 become installation spaces of the delivery roller 55 and the take-up roller 57, and bearing structures (not shown) which respectively support roller shafts 56 and 58 of the delivery roller 55 and the take-up roller 57 in freely rotatable states are respectively provided in the installation spaces.

Further, at the intermediate position between the installation spaces of the delivery roller 55 and the take-up roller 57, a plurality of holder sections 69 which holds push-up members 67 (described later) so as to extend between front and rear inner wall surfaces of the opening portion 43 is provided at positions corresponding to the push-up members 67.

In addition, step-like side edge support sections 61L and 61R which separately support the lower surfaces of left and right side edge portions 59L and 59R of the sheet-like member 53A wound in the width direction B are provided at upper portions of the front and rear inner wall surfaces of the opening 43.

Then, in each holder section 69, the above-mentioned push-up member 67 is fitted which comes into contact with the lower surface of the sheet-like member 53A and pushes it upward, thereby making the height of the facing surface 54 with respect to the recording head 15 of the sheet-like member 53A be at a raised position H1 (FIG. 1), and on the other hand, be retreated below the sheet-like member 53A, thereby making the height of the facing surface 54 with respect to the recording head 15 of the sheet-like member 53A be at a lowered position H2 (FIG. 1).

The push-up member 67 is provided in a plurality at appropriate positions in the width direction B in consideration of the size or the like of the recording material P which is used, and is configured to be able to move up and down so as to individually take the raised position H1 and the lowered position H2. Here, as a structure of allowing the push-up member 67 to individually move up and down, a structure individually having a power source, a structure of making each of the positions H1 and H2 be taken by the combination of a pressure medium and a piston, a structure using a cam mechanism, or the like can be used.

In addition, control of the up-and-down movement of the push-up member 67 is performed by the control section 21, and for example, it is possible to make a configuration so as to make the push-up members 67 which are present within the range of the width dimension of the recording material P which is used or the push-up members 67 which are present within the range of printing data which executes recording be at the raised positions H1, thereby taking slack of the central portion of the sheet-like member 53A to maintain the horizontal position of the recording material P during recording execution.

On the other hand, it is possible to make a configuration so as to make the push-up members 67 which are present outside the range of the width dimension of the recording material P which is used or the push-up members 67 which are present outside the range of the printing data which executes recording be at the lowered positions H2, thereby allowing the waste ink C discharged or abandoned at the time of printing without margins or the time of a flushing operation to be reliably captured by slack portions 71 which can be in the middle of the sheet-like member 53A.

Next, an operation aspect of the ink jet printer 1A related to Example 1 which is configured in this way will be described with a focus on an operation aspect of the waste ink recovery device 51.

If a recording execution command is issued by a user, information set by the user or information about the size or the direction of the recording material P from the recording material P itself set in the ink jet printer 1A is transmitted to and grasped by the control section 21 of the ink jet printer 1A. Further, information about the size or the position of the image 13 which is printed from the printing data transmitted to the ink jet printer 1A is likewise sent to and grasped by the control section 21.

The push-up member 67 being at the raised position H1 and the push-up member 67 being at the lowered position H2 are determined on the basis of information sent to the control section 21 and the push-up members 67 are separately driven by an operation of a shift mechanism (not shown) so as to be at the raised positions H1 or the lowered positions H2.

Next, the delivery roller 55 and the take-up roller 57 are rotated in a given direction by driving a driving motor (not shown), so that the sheet-like member 53A is moved in the direction of movement F shown by an arrow in FIG. 3, for example.

In addition, at this time, in a site where the push-up member 67 is located at the lowered position H2, as shown by a solid line in FIG. 4, the slack portion 71 of a downward recessed shape is formed in the middle between the left and right side edge portions 59L and 59R which are supported by the left and right side edge support sections 61L and 61R.

On the other hand, in a site where the push-up member 67 is located at the raised position H1, as shown by an imaginary line in FIG. 4, the middle portion is also located at approximately the same height as the heights of the left and right side edge portions 59L and 59R because the middle portion is pushed up.

Then, if a leading end portion of the recording material P reaches above the sheet-like member 53A which can move in the direction of movement F in such a state, execution of recording based on the printing data is started, so that desired recording is carried out by the ink C that is discharged from the recording head 15 which reciprocates in the width direction in the recording execution area 23.

Further, during the recording execution, the flushing operation is also carried out at an appropriate timing. In this example, the flushing operation is carried out with use of the flushing position 24A outside the side edge 35R on the reference edge side of the recording material P and the flushing position 24B which is present in a neighborhood area outside the side edge 35L of the recording material P on the opposite side to the side edge 35R.

Then, the waste ink C discharged toward the facing surface 54 with respect to the recording head 15 of the sheet-like member 53A is captured by the sheet-like member 53A. After the recording is finished, the push-up members 67 being at the raised positions H1 are lowered to the lowered positions H2 and the sheet-like member 53 is carried in the direction of movement F in this state and taken up and collected along with the sheet-like member 53A by the take-up roller 57. In addition, also in the case of updating the facing surface 54 by moving the sheet-like member 53 before the end of recording, the push-up members 67 being at the raised positions H1 are lowered to the lowered positions H2.

Therefore, according to the ink jet printer 1A related to this example, a burden to a user of requirement for disposal of the waste ink C can be significantly reduced and the waste ink C can be efficiently recovered. Further, since the movement distance of the recording head 15 to the flushing positions 24A and 24B can be shortened, it becomes possible to attain significant shortening of a recording execution time.

Figure 11:
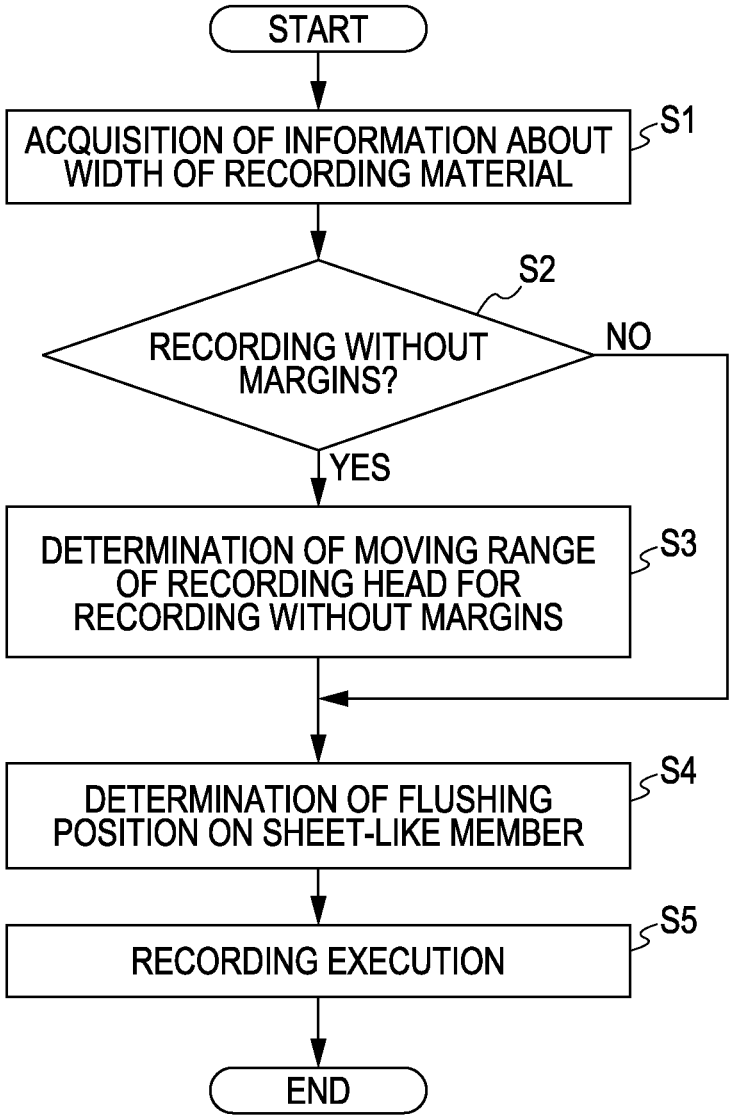
FIG. 11 is a flowchart showing flow of an operation in a case where a control section of the recording apparatus related to Example 1 of the invention sets a flushing position of a recording head in response to the width dimension of a recording material.

FIG. 11 is a flowchart showing flow of an operation in a case where the control section 21 of the recording apparatus related to this example sets the flushing position 24B of the recording head 15 in response to the width dimension of the recording material P. First, in step S1, information about the width of the recording material is obtained. Next, in step S2, whether or not recording which is executed from this time is recording without margins is determined.

In the case of the recording without margins, the routine proceeds to step S3 and a moving range of the recording head 15 for the recording without margins is determined in response to the width of the recording material P.

Subsequently, the routine proceeds to step S4 and the flushing position 24B on the facing surface 54 of the sheet-like member 53 is determined to be at a neighborhood position outside the side edge 35L in response to the width of the recording material P. The flushing portion 24A on the other side edge 35R side is predetermined because it is the reference edge side and does not change. Subsequently, the routine proceeds to step S5 and recording is carried out.

In step S2, when recording is not the recording without margins, that is, it is recording with margins (with blank spaces), the routine proceeds to step S4.

Example 2

Figure 5:
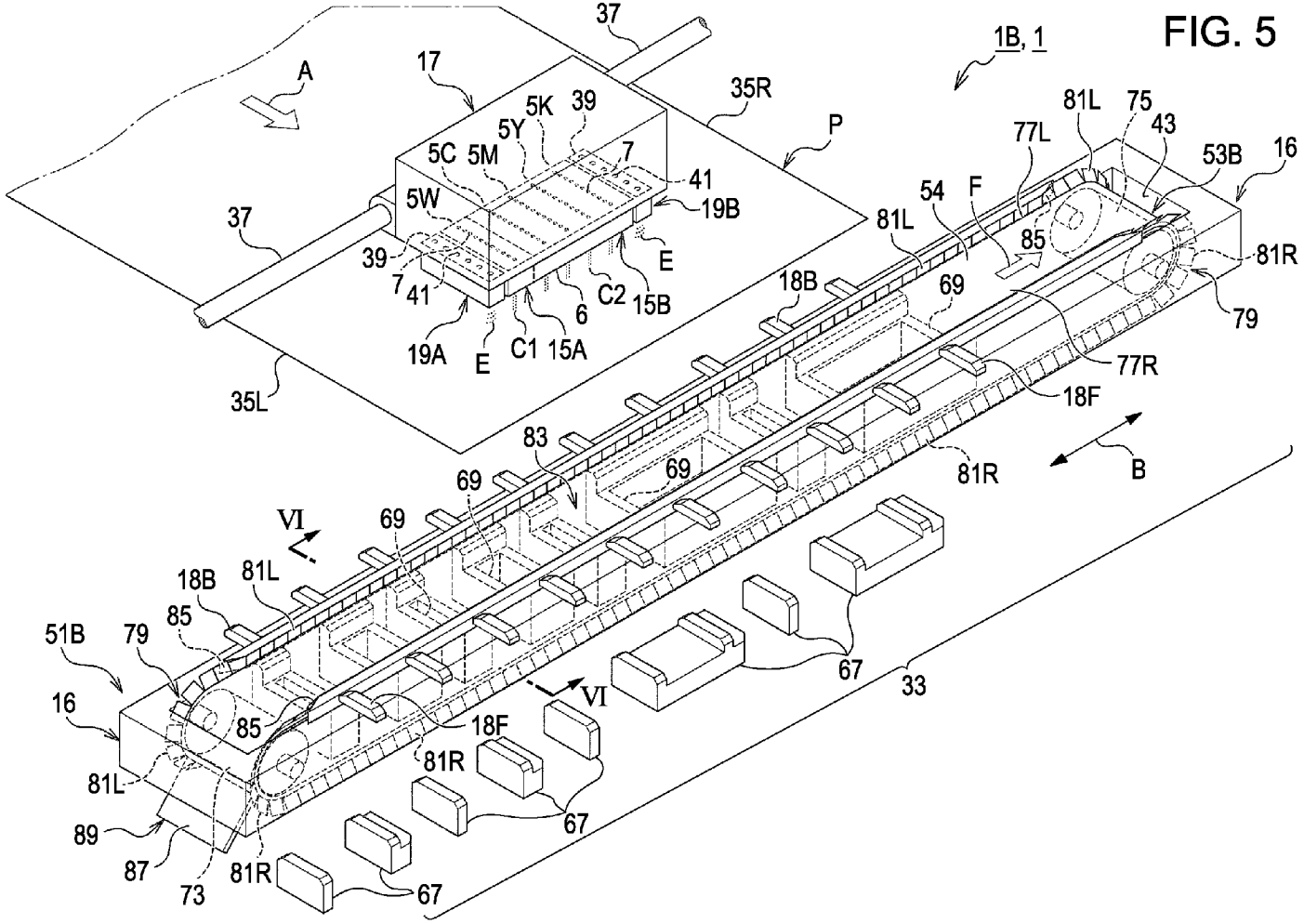
FIG. 5 is an enlarged perspective view showing the periphery of a waste liquid recovery device of a recording apparatus related to Example 2 of the invention.
Figure 6:
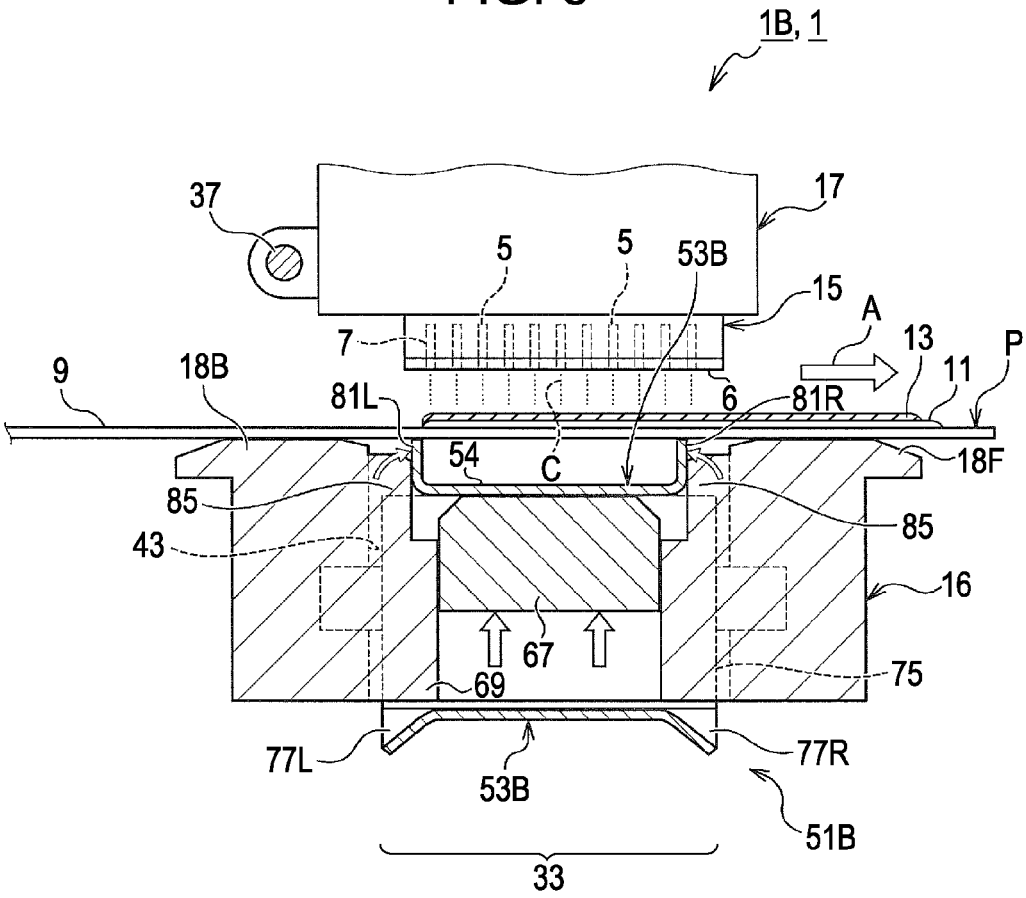
FIG. 6 is an enlarged cross-sectional view taken along line VI-VI of FIG. 5, showing the periphery of the waste liquid recovery device of the recording apparatus related to Example 2 of the invention.

Refer to FIGS. 5 and 6

In an ink jet printer 1B related to Example 2, the configuration of a waste ink recovery device 51B is different from that of the waste ink recovery device 51A in Example 1 described above and other configurations are the same as those in Example 1 described above.

Therefore, here, with respect to the same configurations as those in Example 1 described above, explanation is omitted, and the ink jet printer 1B related to this example will be described with a focus on the configuration of the waste ink recovery device 51B which is different from that in Example 1 described above.

That is, in this example, the waste ink recovery device 51B is provided with a driving roller 73 which is provided on one end side (as an example, the upstream side) in the direction of movement F of a sheet-like member 53B, and a driven roller 75 which is provided on the other end side (as an example, the downstream side) in the direction of movement F of the sheet-like member 53B.

Further, in this example, the sheet-like member 53B is constituted by an endless belt-like member which is wound to pass around the driving roller 73 and the driven roller 75.

Further, in this example, a large number of side edge flaps 81, 81, . . . are formed on the facing surface 54 with respect to the recording head 15 of the sheet-like member 53B by forming slits 79 at appropriate intervals in left and right side edges 77L and 77R of the sheet-like member 53B, and an ink receiving concave portion 83 is formed by rising up the side edge flaps 81.

In association with this, on the front and rear inner wall surfaces of the opening portion 43 of the support member 16, guidance sloping surfaces 85 are provided which raise inward the left and right side edge flaps 81L and 81R which have spread outward in the width direction of the sheet-like member 53B, thereby making the left and right side edge flaps 81L and 81R be in raised positions shown in FIGS. 5 and 6.

Then, according to the waste ink recovery device 51B configured in this way, even if the slack portion 71 is not formed in the sheet-like member 53A, as in Example 1 described above, the above-mentioned ink receiving concave portion 83 is formed on the facing surface 54 with respect to the recording head 15 of the sheet-like member 53B by the side edge flaps 81L and 81R which are in the raised positions.

Therefore, the waste ink C abandoned from the recording head 15 is reliably captured by the ink receiving concave portion 83 formed.

Further, in this example, unlike the sheet-like member 53A in Example 1 described above, the single sheet-like member 53B is repeatedly used. In association with this, a cleaning device 89 which is provided with a scraping blade 87 that removes the waste ink C attached to the facing surface 54 of the sheet-like member 53B by, for example, scraping-off is disposed on the route of a transport path of the sheet-like member 53B.

Then, even in a case where the ink jet printer 1B related to this example which is provided with the waste ink recovery device 51B configured in this way is used, an operation aspect similar to that of the ink jet printer 1A related to Example 1 described above is carried out, so that similar operation and effect are exerted.

In addition, in this example, since the single sheet-like member 53B is continuously used repeatedly, compared to the sheet-like member 53A of a disposable type as in Example 1 described above, it is environmentally friendly and a replacement frequency of the sheet-like member 53B also become low.

Further, in the case of this example, if the waste ink C attached to the sheet-like member 53B is also irradiated with light from the light irradiation section 19 so as to be cured, it is possible to facilitate peeling of the waste ink C by the scraping blade 87. This becomes more effective by forming the facing surface 54 of the sheet-like member 53B of a material that is not easily fixed even if UV curing ink is cured, or by making the facing surface 54 be subjected to the treatment of decreasing fixability.

Example 3

Figure 7:
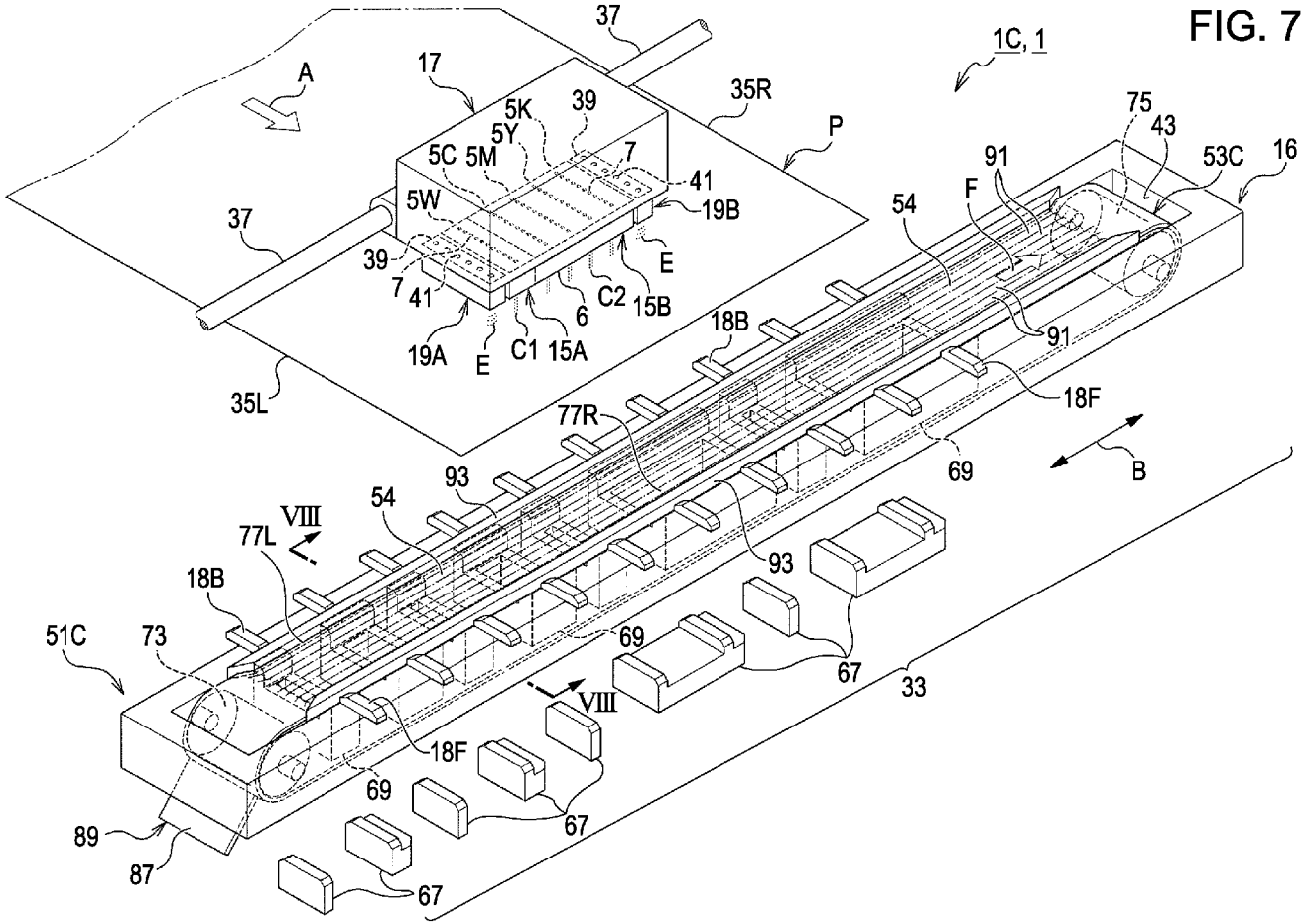
FIG. 7 is an enlarged perspective view showing the periphery of a waste liquid recovery device of a recording apparatus related to Example 3 of the invention.
Figure 8:
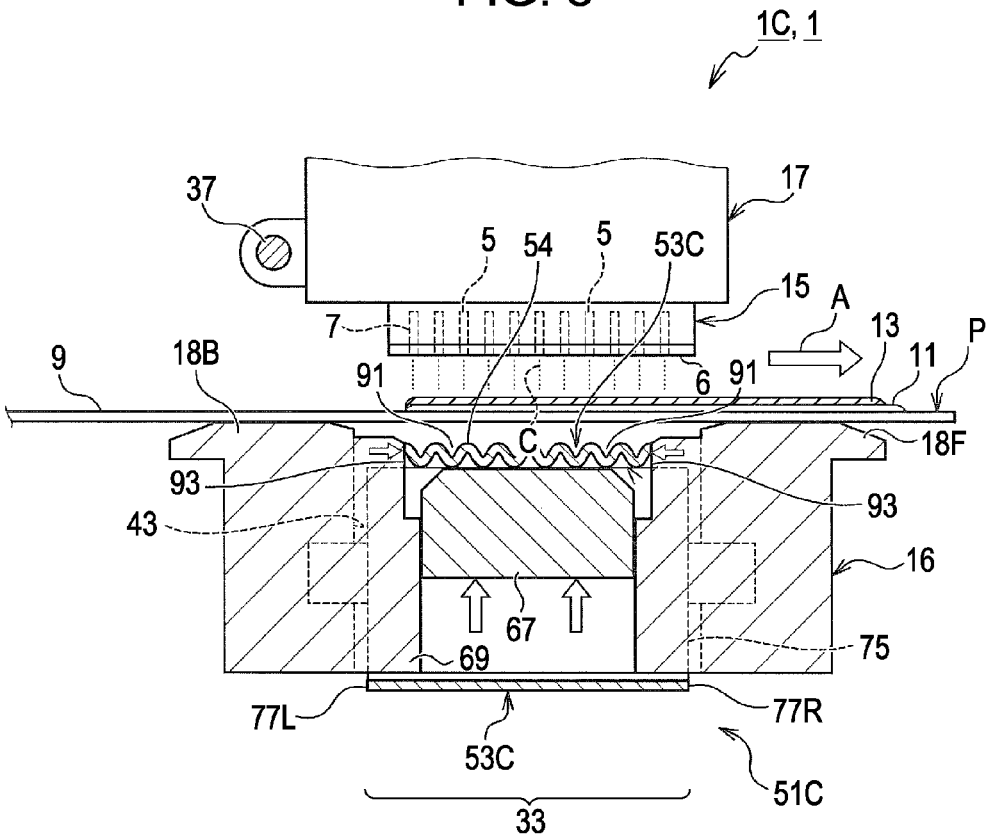
FIG. 8 is an enlarged cross-sectional view taken along line VIII-VIII of FIG. 7, showing the periphery of the waste liquid recovery device of the recording apparatus related to Example 3 of the invention.

Refer to FIGS. 7 and 8

In an ink jet printer 1C related to Example 3, the configuration of a waste ink recovery device 51C is different from that of the waste ink recovery device 51A in Example 1 described above and other configurations are the same as those in Example 1 described above.

Therefore, here, with respect to the same configurations as those in Example 1, explanation is omitted, and the ink jet printer 1C related to this example will be described with a focus on the configuration of the waste ink recovery device 51C which is different from that in Example 1 described above.

That is, in this example, similarly to Example 2 described above, the waste ink recovery device 51C is provided with the driving roller 73 which is provided on one end side (as an example, the upstream side) in the direction of movement F of a sheet-like member 53C, and the driven roller 75 which is provided on the other end side (as an example, the downstream side) in the direction of movement F of the sheet-like member 53C.

Further, also in this example, similarly to Example 2 described above, the sheet-like member 53C is constituted by an endless belt-like member which is wound to pass around the driving roller 73 and the driven roller 75.

Further, in this example, the sheet-like member 53C is formed in the shape of a bellows capable of expanding and contracting in a direction crossing the direction of movement F. In this way, a plurality of ink receiving groove portions 91, 91, . . . is formed in the facing surface 54 with respect to the recording head 15.

In association with this, on the front and rear inner wall surfaces of the opening portion 43 of the support member 16, projecting convex portions 93 which come into contact with left and right side edges 77L and 77R of the sheet-like member 53C and project inward to approach each other are provided as shown in FIGS. 7 and 8.

Then, according to the waste ink recovery device 51C configured in this way, even if the slack portion 71 is not formed in the sheet-like member 53A, as in Example 1 described above, the waste ink C abandoned from the recording head 15 is reliably captured by the plurality of ink receiving groove portions 91, 91, . . . which is formed by a bellows-shaped sheet-like member 53C.

Further, also in this example, similarly to Example 2 described above, the single sheet-like member 53C is repeatedly used. In association with this, the cleaning device 89 which is provided with the scraping blade 87 that removes the waste ink C attached to the facing surface 54 of the sheet-like member 53C by, for example, scraping-off is disposed on the route of a transport path of the sheet-like member 53C.

Then, even in a case where the ink jet printer 1C related to this example which is provided with the waste ink recovery device 51C configured in this way is used, an operation aspect similar to that of the ink jet printer 1A related to Example 1 described above is carried out, so that similar operation and effect are exerted.

In addition, in this example, similarly to Example 2 described above, since the single sheet-like member 53C is continuously used repeatedly, compared to the sheet-like member 53A of a disposable type as in Example 1 described above, it is environmentally friendly and a replacement frequency of the sheet-like member 53C also become low.

Further, since the surface area of the facing surface 54 of the sheet-like member 53C which captures the waste ink C is increased by forming the plurality of ink receiving groove portions 91, 91, . . . , the waste ink C is more reliably captured.

Other Examples

The recording apparatus 1 according to the invention is based on the configuration as described above. However, of course, it is also possible to perform change, omission, or the like of a partial configuration in a scope which does not depart from the gist of the invention of this application.

In the above-described examples, both the flushing position 24A and the flushing position 24B are configured with use of the facing surface 54 of the sheet-like member 53. However, with respect to the flushing position 24A on the reference edge side, it may also be configured by a separate flushing receiving section from the sheet-like member 53 without using the sheet-like member 53. As an example of the flushing receiving section, a hole structure with an ink absorber disposed in a lower portion of a hole can be given.

In this case, since the neighborhood area outside the side edge 35L on the other side of the recording material P which varies according to the width size of the recording material P is only used as the flushing position 24B, by making the direction of movement of the sheet-like member 53 the opposite direction to the direction F in the above-described examples, it is possible to avoid a state where the waste ink C passes through the back side of the recording material P by flushing. In this way, a concern that the recording material may be contaminated by the waste ink can be eliminated.

Further, in the case of carrying out recording in a state where the push-up members 67 are lowered to the lowered positions H2, since movement of the sheet-like member can be performed at any timing during recording execution, in the case of performing recording in which the amount of waste ink is large, this is effective.

Figure 9A:
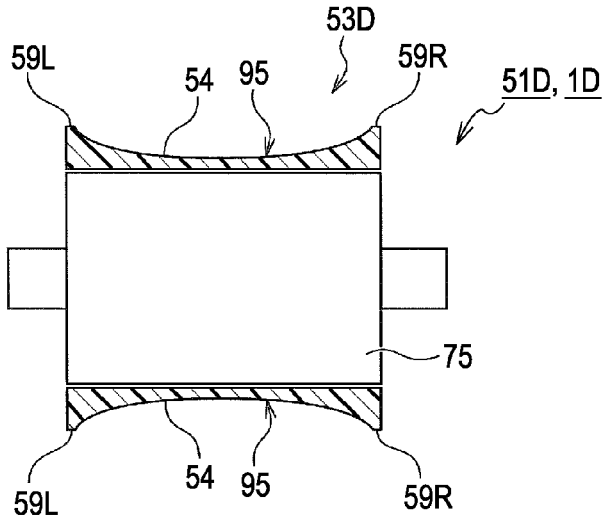
FIGS. 9A to 9C are cross-sectional views showing various cross-sectional shapes of sheet-like members of recording apparatuses related to other examples of the invention.

Further, with respect to the cross-sectional shape of the sheet-like member 53, in addition to a flat rectangular shape in which the facing surface 54 is flat, as shown in Examples 1 to 3 described above, a sheet-like member 53D is also acceptable which has a shape in which a concave portion 95 is formed in the facing surface 54, so that the thicknesses of the left and right side edge portions 59L and 59R become thicker than the middle, as shown in FIG. 9A.

Figure 9B:
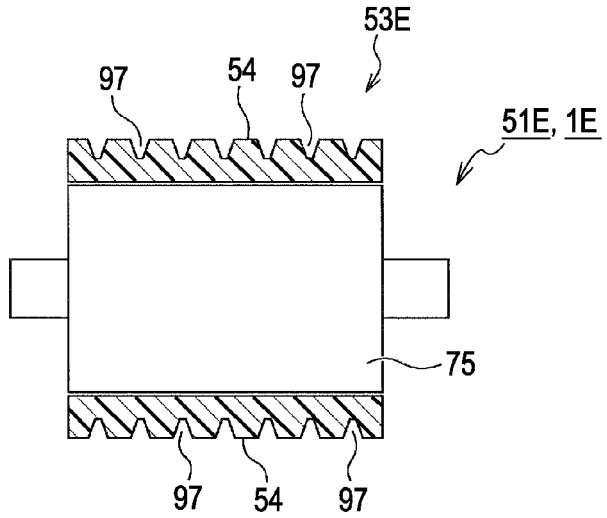
Figure 9C:
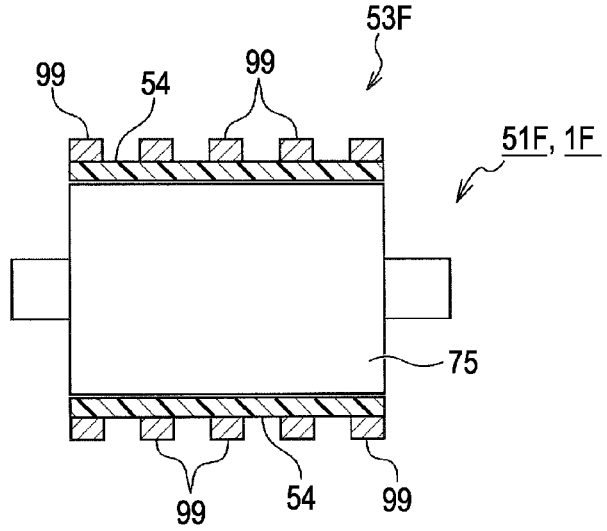

Further, a sheet-like member is also acceptable in which a plurality of streaky groove portions 97, 97, . . . is formed in the facing surface 54 in advance, like a sheet-like member 53E shown in FIG. 9B, and a sheet-like member is also acceptable in which a plurality of ridges 99, 99, . . . is formed in the facing surface 54 in advance, like a sheet-like member 53F shown in FIG. 9C.

Figure 10A:
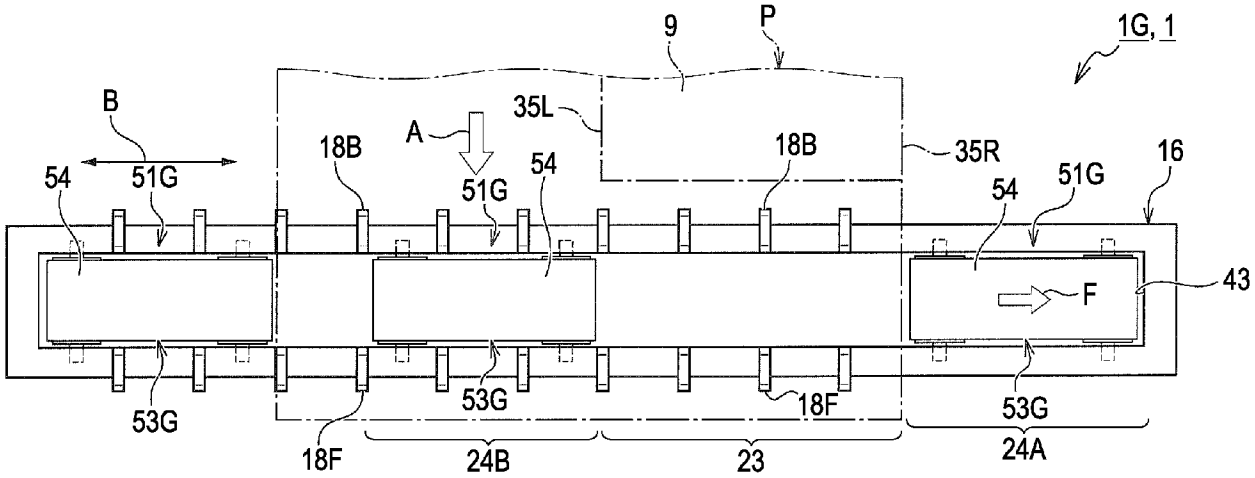
FIGS. 10A and 10B are plan views showing two kinds of disposition aspects of waste liquid recovery devices of recording apparatuses related to still other examples of the invention.
Figure 10B:
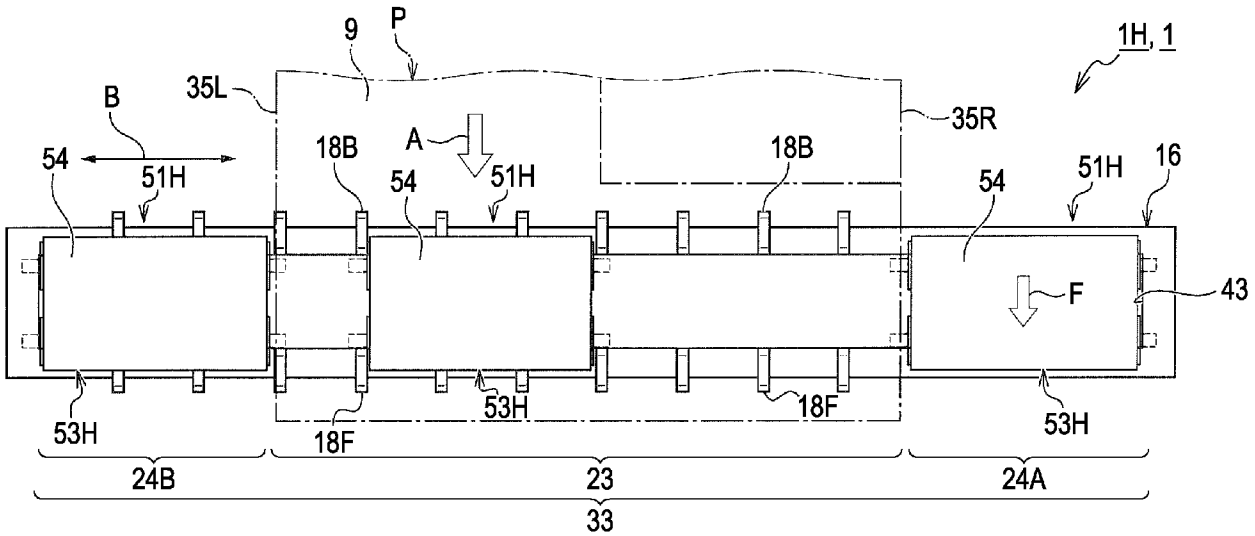

Further, with regard to the waste ink recovery device 51, in addition to a configuration in which only one set is provided in the entire range of the facing area 33 with respect to the recording head 15, a waste ink recovery device can also be provided divided into plural sets in a portion of the facing area 33, as shown in FIGS. 10A and 10B.

Incidentally, in FIGS. 10A and 10B, examples are shown in which one set which is disposed in the neighborhood area (the right side in the drawings) outside the side edge 35R on one side that becomes the reference edge of the recording material P, one set which is disposed in the neighborhood area (the left side in the drawings) outside the side edge 35L on the other side when a postcard-size recording material P is used, and one set which is disposed in the neighborhood area (the left side in the drawings) outside the side edge 35L on the other side when an A4-size recording material P is used, a total of three sets of waste ink recovery devices 51G or 51H are partially disposed.

Further, the direction of movement F of the sheet-like member 53 may also be set to follow the width direction B crossing the transport direction A of the recording material P, as in an ink jet printer 1G shown in FIG. 10A, and can also be set to follow the transport direction A of the recording material P, as in an ink jet printer 1H shown in FIG. 10B.

In addition, the sheet-like members 53B and 53C adopted in Examples 2 and 3 described above can be adopted in the ink jet printer 1A in Example 1, and a sponge material or the like having an excellent ink-absorption property can also be disposed on the facing surface 54 with respect to the recording head 15 of the sheet-like member 53.

Further, as the recording head 15 which is adopted in the ink jet printer 1 according to the invention, there is no limitation to the serial type recording head 15 adopted in each example described above and a line type recording head 15 which is provided in a fixed state and performs printing on the entire range in the width direction B of the recording surface 9 of the recording material P at once may also be adopted.

The entire disclosure of Japanese Patent Application No. 2011-130639, filed on Jun. 10, 2011 is expressly incorporated by reference herein.

What is claimed is:

1. A recording apparatus comprising:

a recording head which discharges liquid onto a recording material, thereby performing recording;

a waste liquid recovery device which recovers waste liquid which has not been attached to the recording material, of liquid discharged from the recording head;

a support member which has a central opening portion, an upstream side support surface that is upstream of the central opening portion and a downstream side support surface that is downstream stream of the central opening portion, the side support surfaces supporting a lower surface of the recording material in a transport direction of the recording material, wherein the waste liquid recovery device includes a movable sheet-like member that is different from the recording material which is provided on a side facing the recording head between the upstream side support surface and the downstream side support surface and receives the waste liquid which has not been attached to the recording material, wherein the sheet-like member can move in a direction that is perpendicular to the transport direction of the recording material, and wherein the waste liquid recovery device includes a holder section that includes a push-up member, the push-up member being able to raise up or lower a portion of the sheet-like member such that a distance between the sheet-like member and the recording head is configured to be variable.

2. The recording apparatus according to claim 1, wherein the recording head can reciprocate in a width direction crossing a transport direction of the recording material, the recording apparatus includes a control section which controls each operation of the recording head and the waste liquid recovery device, and the control section is configured so as to set a flushing position of the recording head in response to the width dimension of the recording material.

3. The recording apparatus according to claim 1, wherein the waste liquid recovery device includes a first roller which is provided at an upstream position in a direction of movement of the sheet-like member, and a second roller which is provided at a downstream position in the direction of movement of the sheet-like member, the sheet-like member is a long roll-shaped member wound around the first roller into the form of a roll, and the long roll-shaped member is configured so as to be taken up by the second roller.

4. The recording apparatus according to claim 1, wherein the waste liquid recovery device includes a driving section which is provided on one end side in a direction of movement of the sheet-like member, and a driven section which is provided on the other end side in the direction of movement of the sheet-like member, and the sheet-like member is an endless belt which is wound to pass around the driving section and the driven section.

5. The recording apparatus according to claim 1, wherein the sheet-like member is provided with a plurality of side edge flaps by having slits at appropriate intervals in a direction of movement of the sheet-like member at both side edges in the transport direction of the recording material, and the side edge flaps are configured to be able to rise up to the recording head side.

6. The recording apparatus according to claim 1, wherein the sheet-like member is formed in the shape of bellows capable of expanding and contracting in a direction crossing a direction of movement.

7. The recording apparatus according to claim 1, wherein the distance is configured to be capable of being set to be different sizes in an area in the width dimension of the recording material and an area outside the width dimension.

8. The recording apparatus according to claim 1, wherein the liquid which is discharged from the recording head is light curing ink which is cured in response to light, and a light irradiation section which irradiates the light curing ink discharged from the recording head with light is provided near a side of the recording head.

9. The recording apparatus according to claim 1, wherein the push-up member raises up the portion of the sheet-like member to an approximately same height as heights of the upstream side support surface and the downstream side support surface when the sheet-like member receives the waste liquid.

10. The recording apparatus according to claim 1, wherein the distance between the sheet-like member and the recording head is configured to be variable when the sheet-like member receives the waste liquid.

11. The recording apparatus according to claim 10, wherein the waste liquid recovery device includes a plurality of the holder sections in the direction that is perpendicular to the transport direction of the recording material.

* * * * *